US009105363B2

(12) United States Patent
Benke et al.

(10) Patent No.: US 9,105,363 B2
(45) Date of Patent: Aug. 11, 2015

(54) METHODS FOR VAPORIZATION AND REMEDIATION OF RADIOACTIVE CONTAMINATION

(71) Applicant: Southwest Research Institute, San Antonio, TX (US)

(72) Inventors: Roland R. V. Benke, Helotes, TX (US); Ralph H. Hill, Jr., San Antonio, TX (US); Roberto T. Pabalan, San Antonio, TX (US); James A. Moryl, Helotes, TX (US); Jeremy R. Pruitt, Helotes, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 189 days.

(21) Appl. No.: 13/692,678

(22) Filed: Dec. 3, 2012

(65) Prior Publication Data

US 2014/0249345 A1 Sep. 4, 2014

Related U.S. Application Data

(60) Provisional application No. 61/565,783, filed on Dec. 1, 2011.

(51) Int. Cl.

| | |
|---|---|
| ***A62D 3/178*** | (2007.01) |
| ***G21F 9/20*** | (2006.01) |
| ***G21F 9/00*** | (2006.01) |
| *G21F 9/30* | (2006.01) |

(52) U.S. Cl.

CPC ..... *G21F 9/001* (2013.01); *G21F 9/005* (2013.01); *G21F 9/30* (2013.01)

(58) Field of Classification Search

CPC ..... G21F 9/20; A62D 3/178

USPC ..... 588/1, 18, 19, 20, 310, 301, 410, 412

See application file for complete search history.

(56) References Cited

U.S. PATENT DOCUMENTS

| | | | | |
|---|---|---|---|---|
| 5,185,104 | A * | 2/1993 | Horie | 588/19 |
| 5,283,010 | A | 2/1994 | Waring | |
| 5,405,509 | A * | 4/1995 | Lomasney et al. | 205/688 |
| 5,538,764 | A | 7/1996 | Li et al. | |

OTHER PUBLICATIONS

Spalding, "Volatillzation of Ceslum-137 From Soil With Chloride Amendments During Heating and Vitrification"; Environmental Sciences Technology, 1994, vol. 28, No. 6, pp. 1118-1123.

Chandrasekaran, et al; "Microwave Material Processing—A Review", American Institute of Chemical Engineers, Fluid Mechanics and Transport Phenomena—Journal Review, Feb. 2012, vol. 58, No. 2, pp. 330.

Di, et al; "Heat and Mass Transfer During Microwave Steam Treatment of Contaminated Soils"; Journal of Environmental Engineering, Dec. 2000, pp. 1108-1115.

Finston, et al, "The Radiochemistry of Cesium"; National Academy of Sciences, National Research Council, Nuclear Science Series: Monographs on Radiochemistry and Radiochemical Techniques, NAS-NS-3035, Feb. 1961 (latest printing Mar. 1978); pp. 1-69 (78 pgs total).

Kawala, et al; "Microwave-Enhanced Thermal Decontamination of Soil"; Environmental Science & Technology / 1998, vol. 32, No. 17, pp. 2602-2607.

Li, et al: "Microwave Thermal Remediation of Crude Oil Contaminated Soil Enhanced by Carbon Fiber"; Journal of Environmental Sciences vol. 21 (2009), pp. 1290-1295.

Lorenz, et al "Behavior of Iodine, Methyl Iodide, Cesium Oxide, and Cesium Iodide in Steam and Argon"; available from National Technical Information Service, US Dept. of Commerce: ORNL/NUREG/TM-25, NRC-3 (56 pgs).

Menendez, et al: "Microwave-Induced Pyrolysis of Sewage Sludge", Elsevier Science Ltd., Water Research 36, 2002, pp. 3261-3264.

Spalding, "Volatillzation of Ceslum-137 From Soil With Chloride Amendments During Heating and Vitrification"; Enviornmental Sciences Technology, 1994, vol. 28, No. 6, pp. 1118-1123.

* cited by examiner

*Primary Examiner* — Edward Johnson

(74) *Attorney, Agent, or Firm* — Grossman, Tucker et al

(57) ABSTRACT

A method for collecting volatile radioactive substances. The method includes irradiating a volatile radioactive substance on or under a contaminated material surface using microwave radiation and vaporizing the volatile radioactive substance, wherein the volatile radioactive substance comprises at least one of cesium and iodine. The method further includes recovering the vaporized volatile radioactive substance from the contaminated material. The method may be accomplished with and/or without physically collecting or isolating the contaminated material.

15 Claims, 6 Drawing Sheets

120
140
110
112

130
134
132
136
120
140
112

FIG.1e
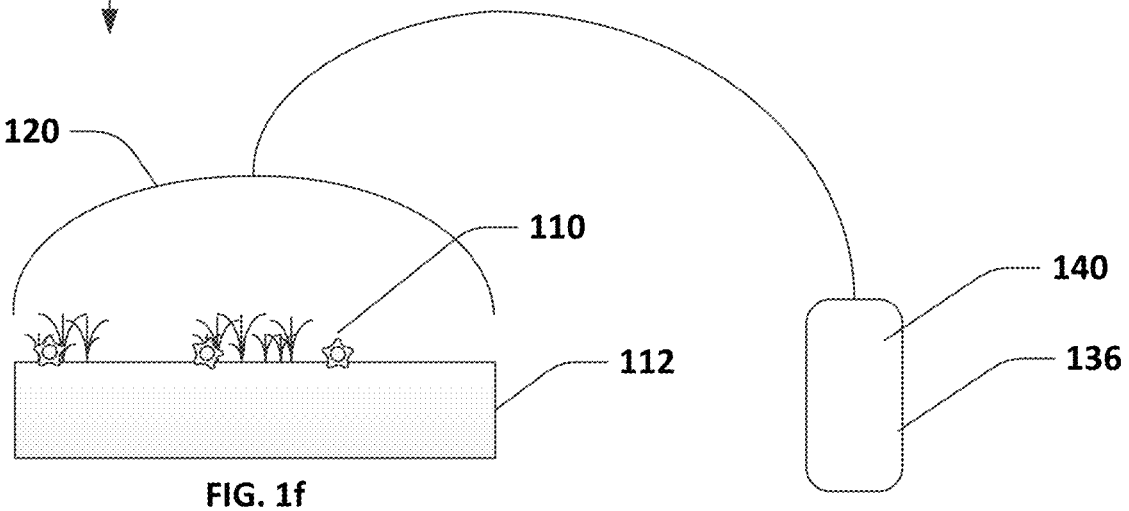
FIG. 1f
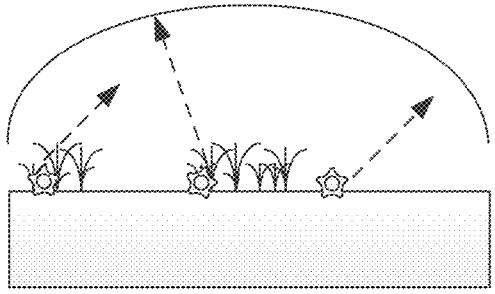
FIG. 1g
FIG. 1c

METHODS FOR VAPORIZATION AND REMEDIATION OF RADIOACTIVE CONTAMINATION

CROSS-REFERENCE TO RELATED APPLICATIONS

The present application claims the benefit of U.S. Provisional Application No. 61/565,783, filed on Dec. 1, 2011, the teachings of which are incorporated herein by reference.

FIELD OF THE INVENTION

The present invention is directed at apparatus and methods to remediate and vaporize radioactive contamination from various surfaces including earth surfaces, such as soil, sand and/or clays, roadways or buildings and to collect the recovered contaminant. The procedure may be implemented in a manner that does not require physical collection of the surface material but may also be employed to decontaminate removed surface material and replenish such surfaces with non-contaminated material.

BACKGROUND

The release of radioactive material into the environment is a compelling problem. Radioactive wastes are typically the by-products of nuclear power generation and other systems that rely upon nuclear fission or nuclear technology. Radioactive contamination may also be extremely problematic when damage occurs to a nuclear power generating station, such as the 2011 damage to the Fukushima-Daiichi nuclear power generating station in Japan. This resulted in the atmospheric release of radioactive material and widespread contamination of earth surface materials, such as soil and the minerals contained therein.

Remediation alternatives are reported in the literature for the removal of radioactive contamination. However, a need still exists to provide more efficient remediation protocols that would be particularly applicable to the targeted recovery of relatively volatile radioactive waste material in earth surface and near-surface materials that have absorbed or adsorbed such contamination. Accordingly, one of several objects herein is to provide a process that may be implemented directly to a contaminated surface without the need to physically collect the surface material and treat for radioactive pollution.

SUMMARY

An aspect of the present disclosure relates to a method for collecting volatile radioactive substances. The method includes irradiating a volatile radioactive substance on or under a contaminated material surface using microwave radiation and vaporizing the volatile radioactive substance, wherein the volatile radioactive substance comprises at least one of cesium and iodine. The method further includes recovering the vaporized volatile radioactive substance from the contaminated material.

A further aspect of the present disclosure relates to an apparatus for collecting volatile radioactive substances. The apparatus includes a hood, which is configured to at least partially surround a contaminated material. The apparatus also includes a microwave radiation source, wherein the microwave radiation source is configured to provide microwave radiation to the contaminated material and vaporize a volatile radioactive substance, which comprises at least one of cesium and iodine. The apparatus further includes a recovery unit including a vacuum pump and a reservoir, wherein the recovery unit is in fluid communication with the hood. In addition, the apparatus includes a detector, wherein the detector is configured to detect the volatile radioactive substance.

Yet a further aspect of the present disclosure relates to a system for removing volatile radioactive substances. The system includes a detector, configured to detect a volatile radioactive substance, wherein the volatile radioactive substance comprises at least one of cesium and iodine. The system also includes a processor operatively coupled to the detector configured to determine the concentration of the volatile radioactive substance present. The system further includes a lookup table accessible by said processor including a plurality of radiation parameters for irradiating and vaporizing the volatile radioactive substance. The processor is configured to compare the concentrations of the volatile radioactive substance with a target concentration stored in the lookup table and to select at least one of the radiation parameters. In addition, the system includes a microwave radiation source in communication with the processor.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein:

FIGS. 1*a* through 1*g* illustrate an embodiment of a method of recovering a volatile radioactive substance from a porous solid material, such as soil;

DETAILED DESCRIPTION

Figure 1A:
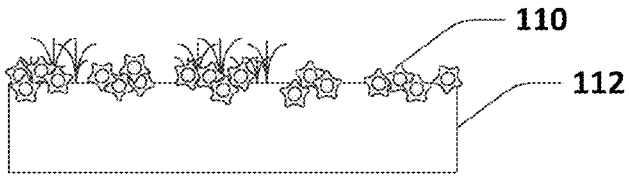

It has been recognized herein that damage to nuclear power generating stations can result in the atmospheric release of radioactive contamination, and in particular, widespread contamination of the earth's surface materials (soil, sand and/or clays), which are generally understood to be porous solid materials, as well as on roadways and buildings. In particular, relatively large amounts of radioactivity are associated with volatile species such as Iodine-131 ($^{131}$I), Iodine-135 ($^{135}$I), Cesium-134 ($^{134}$Cs), Cesium-136 ($^{136}$Cs) and Cesium-137 ($^{137}$CS).

More specifically, $^{131}$I, $^{135}$I and $^{136}$Cs have half-lives of 8 days, 7 hours and 13 days, respectively. $^{137}$Cs and $^{134}$Cs have half-lives of 30 and 2 years, respectively. Accordingly, radioactive cesium or iodine contamination on surfaces, such as in earth surface material, remains a primary concern in the event such volatile isotopes are released into the environment and absorbed within or adsorbed to a variety of earth surface materials. Appreciable masses exist of other volatile species, such as Iodine-129 ($^{129}$I) and Cesium-135 ($^{135}$Cs). However, their radioactive properties, ($^{129}$I and $^{135}$Cs have extremely long half-lives of about 16 million years and 2.3 million years respectively,) relegate the radiological concerns for these species to be minor compared to the much larger radioactivity associated with $^{137}$Cs and $^{134}$Cs.

According to the present invention, a process and apparatus are now provided which may be applied directly to radioactive contaminated material such as earth surface material, which may include soils, sand, clays, etc. Radioactive material may be understood as material that emits ionizing radiation, such as gamma rays, x-rays, beta particles, alpha particles and combinations thereof. Earth surface materials that may be treated herein includes any particular contaminated material found on the surface of the earth that may also be solid and/or porous and which may absorb or adsorb a volatile radioactive contaminant. Contaminated material is therefore understood to include any material upon or in which a radioactive substance is present. Treatment may be performed in situ, with the contaminated material remaining in place. This reduces secondary contamination caused by the spreading of particles during remediation when earth is moved from one location to another. While the subject matter herein is explained in the context of porous or solid earth materials, it should be appreciated that treatment of any inorganic material is contemplated herein.

The volatile radioactive substance herein may comprise any radioactive contaminant that may become dispersed in air and then become absorbed within and/or adsorbed to the earth surface materials described above. The volatile radioactive components herein are contemplated to include any radioactive isotope or compound that may be capable of being volatized and directly recovered from its host substrate material. The volatile radioactive isotopes or chemical compounds that are particularly contemplated herein include, consist essentially of, or consist of cesium and iodine, and in particular $^{137}Cs$, $^{134}Cs$, and/or other isotopes such as $^{131}I$, $^{135}I$ and $^{136}Cs$.

In such regard, it has been recognized herein that microwave heating is capable of promoting the vaporization of such exemplary radioactive cesium isotopes. That is, the volatile radioactive substance is heated to a temperature sufficient to volatilize the radioactive substance. Natural cesium ($^{133}Cs$) has a resonant frequency of 9.2 GHz, which is particularly suitable to microwave heating and which can be volatilized and removed from the contaminated material. Furthermore, $^{134}Cs$ and $^{137}Cs$ atoms have resonant frequencies of 10.5 and 10.1 GHz respectively, which are also suitable to microwave heating. The chemical form of the contamination, such as cesium oxides ($Cs_2O$ and $CsO_2$) and/or cesium iodide (CsI), and its incorporation into the crystal structure of minerals, such as illite clay minerals for cesium contamination, may change the preferred microwave frequency for radioisotope excitation as well as the requisite absorbed energy or temperature for effective vaporization and remediation. For the previously presented resonant frequencies of cesium atoms, shifts in resonant frequencies due to chemical form are expected to be within approximately 0.2 GHz.

Accordingly, by utilizing microwave radiation that is specifically configured and tuned to target the volatile radioactive substance, contaminated material or both, one may more efficiently volatilize and remove such isotopes without exposing the host environment, i.e., the surrounding environment, to an excessive or prolonged heating condition. Microwave radiation in the frequency range of 0.1 GHz to 25 GHz may be preferred, including all values and ranges therein such as in the range of 0.3 GHz to 20 GHz. Microwave radiation of multiple frequencies may be employed in embodiments, such as those where more than one volatile radioactive isotope and chemical substance are present and each isotope or chemical substance exhibits a different resonant frequency. These multiple frequencies may or may not include the resonant frequencies of the volatile radioactive isotopes and chemical compounds or the resonant frequencies of chloride amendments discussed herein.

Furthermore, it has been recognized that, e.g., in the case of the volatile cesium radioactive isotopes, a majority of such contamination may typically be found at relatively greater concentrations in the top and/or exposed layers of the earth surface material such as soil (up to 5.0 cm in depth). Accordingly, upon application of microwave heating to earth surfaces that have been contaminated by the atmospheric release and deposition of cesium, radioactive cesium isotopes may be removed without physically disturbing the surface material. For example, for a given soil surface that is up to 5.0 cm thick, and which has been exposed to radioactive cesium contamination, a significant fraction, such as 50-100% by weight of the radioactive cesium contamination, may now be removed upon exposure to microwave radiation. The microwave radiation is preferably of sufficient intensity to vaporize the radioactive cesium contamination which may then be recovered efficiently.

It should be noted that other chemical substances beyond the contaminating radioactive isotopes may be present in the soil. Cesium exhibits a boiling temperature of 671° C. at standard pressure, i.e., 1 atm. Iodine exhibits a boiling temperature of 184.3° C. at standard pressure, i.e., 1 atm. However, initial release conditions, exposure to the atmosphere, and environmental media will affect the chemical form of deposited contaminants. For example, cesium monoxide $Cs_2O$ may be present which vaporizes at 250° C. at standard pressure (i.e., 1 atm), or other chemical forms of cesium may be present with different and/or higher vaporization temperatures. As a consequence, it is contemplated herein that one may also utilize relatively higher temperatures than that which would otherwise be employed to remove the volatile isotopes described herein.

That is, the temperature applied herein is contemplated to provide cesium temperatures mainly between 100° C. and 1000° C., but potentially up to 1300° C., to more efficiently remove the majority of cesium and analog compounds that may have been formed and absorbed or adsorbed. By tuning the microwave frequencies for the resonant frequencies of the various radioisotopes or other suitable frequencies, higher contaminant temperatures can be achieved with less microwave power consumption. For example, the microwave frequency may be tuned to one or more frequencies within +/−0.2 GHz of the resonant frequency of the isotope.

To achieve such temperatures through microwave heating, the contaminated surface may be augmented by a chemical amendment, such as chloride and limestone amendments, or combinations thereof, to enhance the release of cesium or other volatile radioactive substances. Chloride amendments may include chloride-containing species such as sodium chloride, potassium chloride, calcium chloride, hydrochloric acid and poly(vinyl chloride). The amendments may be spread over or mixed into the contaminated materials. Additional heating herein may also be supplied by, e.g., infrared or laser radiation sources or combinations thereof. Furthermore, it is contemplated herein that one may also apply a localized vacuum to further enhance the removal efficiency of the radioactive contaminants.

It may be appreciated that the above remediation approach for the removal of the volatile radioactive contaminant enables measurement and verification of contamination in earth surface materials, directly at the site. That is, one may detect and measure surface and near-surface contamination prior to the remediation procedures noted herein. In the event that the levels of contamination are relatively high, it is contemplated that longer exposure to microwaves may be applied which in turn provides relatively longer time periods for vaporization of the volatile radioactive contaminant to be realized. On the other hand, for relatively low levels of volatile radioactive contamination, relatively shorter exposure times can be employed. In addition, in either case, in the event that contamination levels after remediation remain above a target level, additional remediation can be applied.

The present invention therefore relates to a method for removing a volatile radioactive isotope or compound from a contaminated material, such as earth surface material, which may be capable of absorbing and/or adsorbing the radioactive isotope, comprising: (a) irradiating the material with microwaves of sufficient intensity to vaporize the volatile radioactive isotope within 5.0 cm of the material surface; and (b) removing the volatile radioactive isotope. The thickness of 5.0 cm depends on the required absorbed energy and contaminant temperature for effective vaporization and remediation; certain isotopes and chemical forms with lower absorbed energy and temperature requirements may be effectively removed from depths greater than 5.0 cm. The method may be accomplished with and/or without physically collecting or isolating the solid material. For applications that involve the physical collection and processing of the contaminated material in a microwave chamber that surrounds material, the remediation thickness can be greater than 5.0 cm. The contaminated material may be either porous or solid and comprise earth surface material including soil, sands, clays, vegetation or environmental debris. The radioactive isotope may specifically comprise a cesium or iodine isotope, and more specifically, may comprise a mixture of cesium isotopes, $^{137}$Cs, $^{134}$Cs, and/or $^{136}$Cs. Any earth surface material or contaminated surfaces so treated may therefore be reclaimed and, depending on the depth of contamination and temperatures required for remediation, be utilized for its normal intended purpose.

Figure 1B:
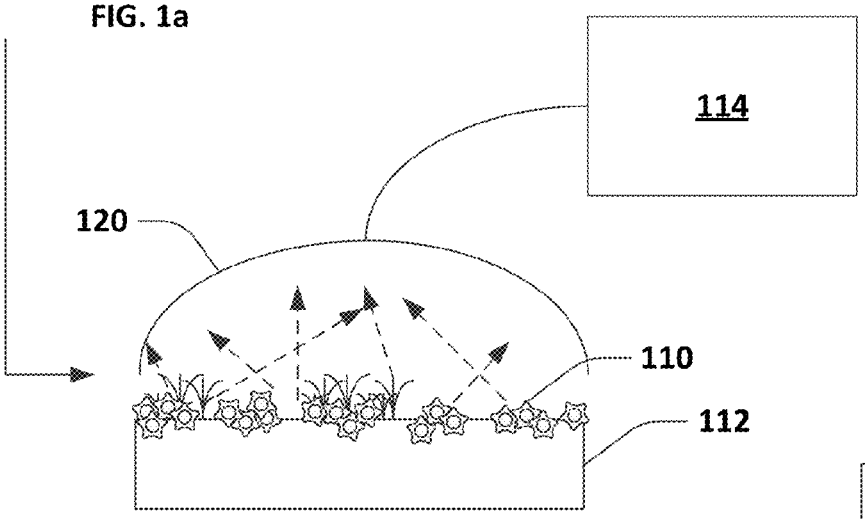

Reference is made herein FIGS. 1*a* through 1*g*, illustrating an embodiment of a method for removing volatile radioactive particles 110 from the ground 112 as seen in FIG. 1*a*. The method optionally begins by determining if contamination levels are acceptable or not. Testing may be performed in situ, as illustrated in FIG. 1*b*, using an isotopic identifier or detector 114. Once it is determined that contamination is present at an unacceptable level, decontamination may be initiated.

Figure 1C:
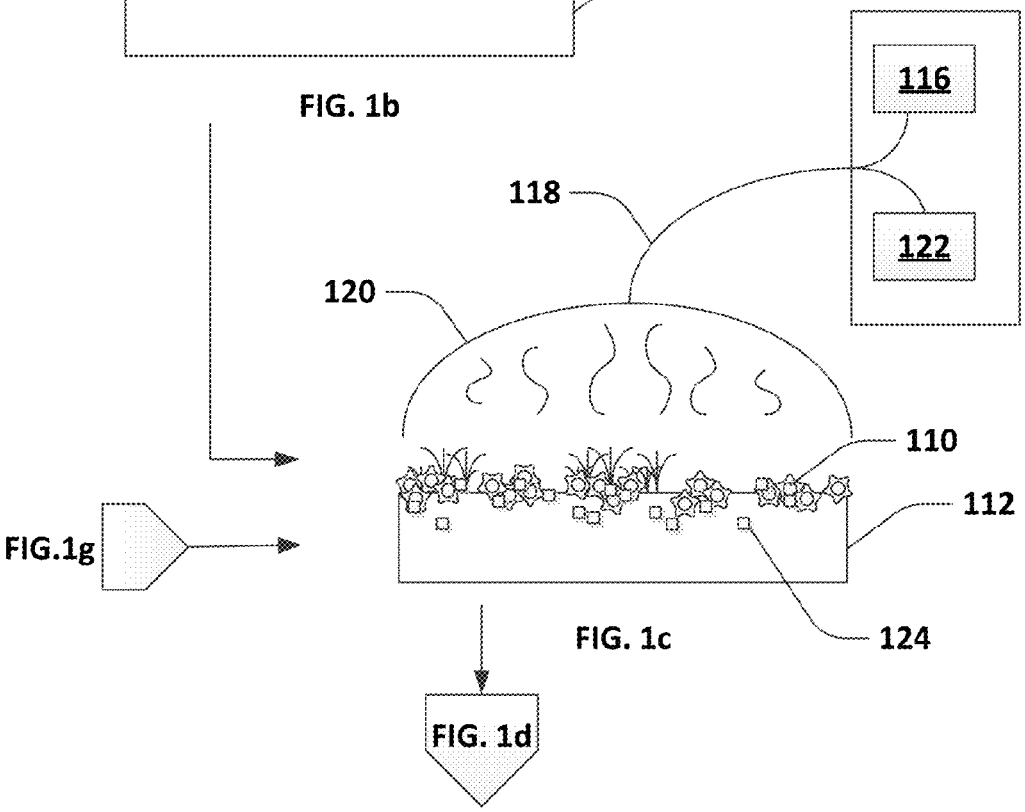

Decontamination may be facilitated, as illustrated in FIG. 1*c*, by heating and vaporizing the volatile radioactive particles using a microwave source 116 tuned to the resonant frequencies of the identified radioactive particles or other suitable frequencies that may result in the vaporization of the volatile radioactive substances as alluded to above. The microwave source may be utilized in conjunction with a waveguide 118 to direct the microwaves to the area to be treated. A hood 120 may be suspended over and at least partially surround the area to be heated to reduce stray microwave emission. An infrared or laser heating source 122 and/or chloride amendment 124 to the contaminated material, such as NaCl, may optionally be utilized in conjunction with the microwave source. The microwaves may provide effective vaporization and remediation up to 5.0 cm from the surface. As the boiling or vaporization temperature of cesium for its specific chemical form and bond within the contaminated material is reached, cesium temperatures of 671° C. or greater may be achieved, including all values and ranges for example, primarily from 100° C. to 1000° C. and up to 1300° C., from 500° C. to 900° C., etc. Upon achieving such temperatures, the cesium may vaporize as well as any additional volatile substances having volatilization temperatures/boiling temperatures below the attained temperature. Chemical decomposition may also occur as a result of the heating and vaporization process.

Figures 1C, 1D, 1E, 1F:
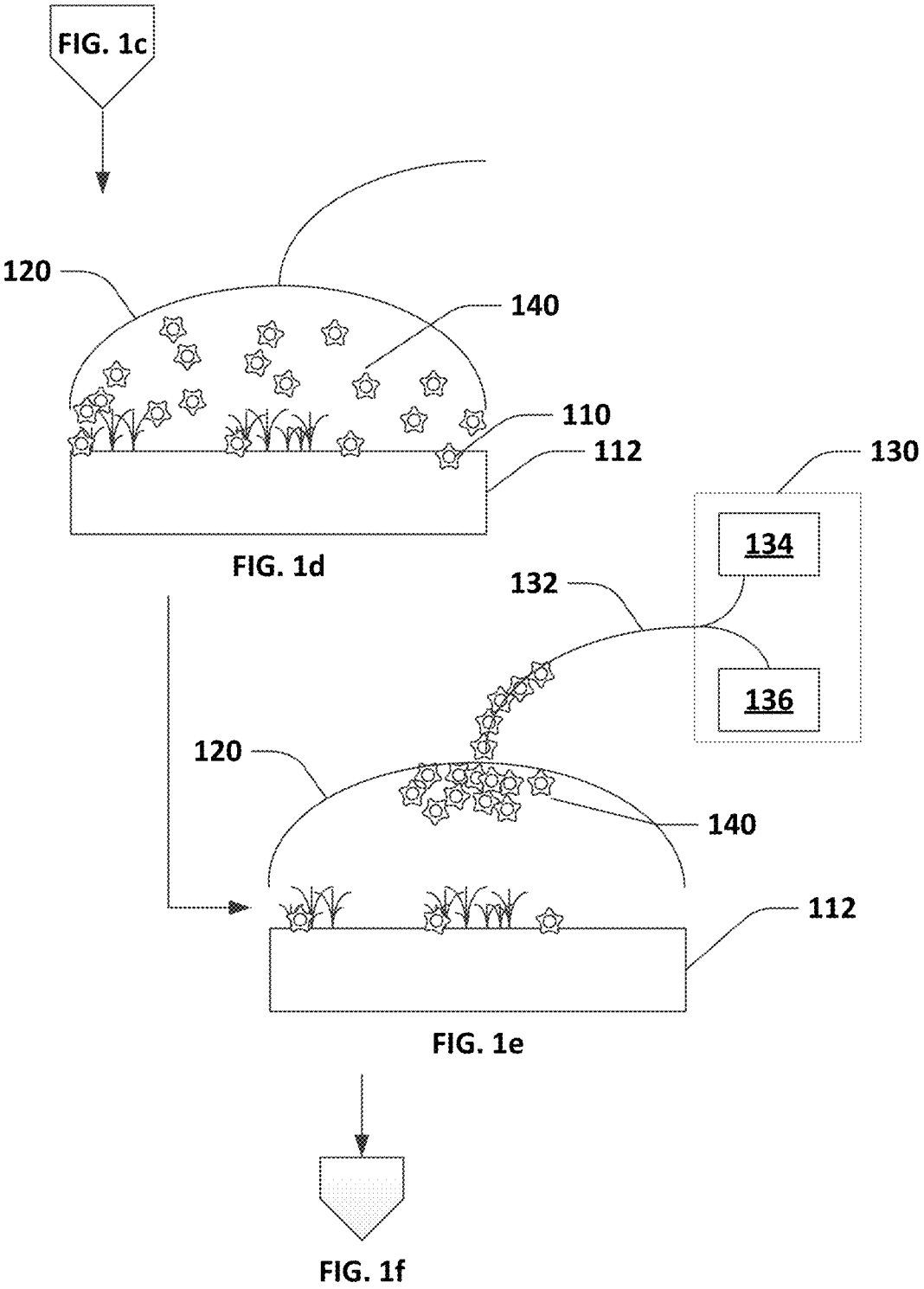

Once volatilized as illustrated in FIG. 1*d*, the cesium vapor 140, as well as the vapor of other volatilized materials, may rise from the ground 112 into a carrier gas (typically air), collect in the hood 120, and be drawn into a recovery unit 130 through a duct 132 as illustrated in FIG. 1*e*. The duct may be separate from or, alternatively, integrated with the waveguide. The recovery unit 130 may utilize a vacuum pump 134 to evacuate the vapor in the carrier gas from the collection hood and deposit the vapor into the recovery unit 130. In addition a reservoir 136 may be provided in which vapor is collected, as illustrated in FIG. 1*f*. The reservoir may include a filtration unit, a cold trap, or combinations thereof, in which the cesium is condensed and/or collected. Filtration units may include one or more filters, such as molecular filters. An exhaust may also be provided to release the carrier gas after the cesium has been removed from the gas.

The area may then be rescanned, FIG. 1*g*, to determine the remaining concentration of the volatile radioactive component. If the concentration remains too high then the process may be repeated using the same or different irradiation parameters, starting again, for example, at FIG. 1*c*.

Figure 2:
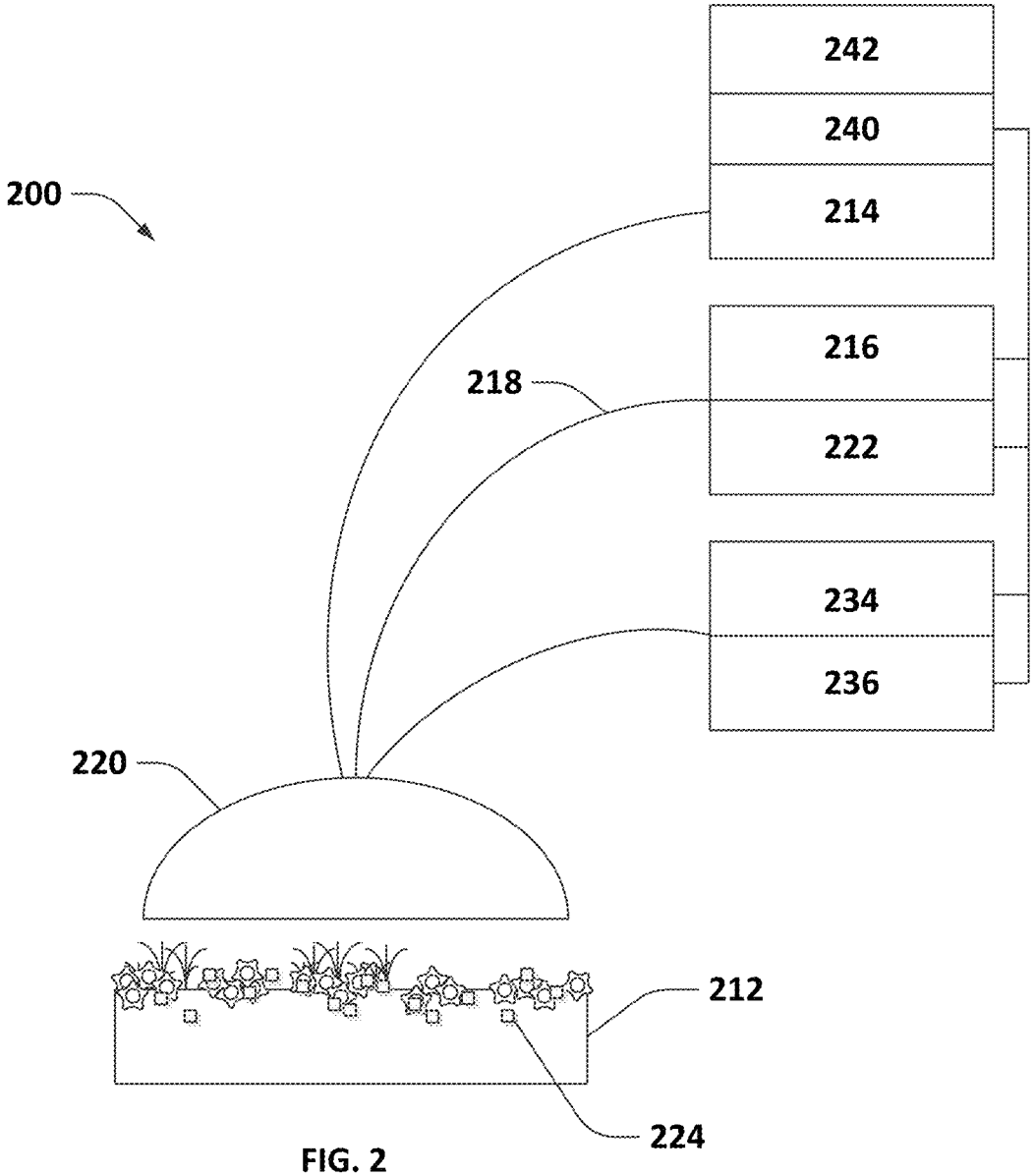
FIG. 2 illustrates a schematic of an embodiment of an apparatus for collecting a volatile radioactive substance.

In apparatus form, illustrated in FIG. 2, the present invention comprises a collection device 200 including a microwave radiation source or heating device 216 that may apply microwave radiation directly to a contaminated material to remove volatile radioactive isotopes. The device 200 may include a secondary infrared or laser heating source 222 and/or chloride amendment. The device 200 may also include a recovery unit 234, such as a vacuum collection system, a reservoir 236 and detection equipment 214 to identify radioactive contamination. The detection equipment may include the above mentioned isotopic identifier such as one or more semiconductor gamma-ray spectrometers or scintillators, including sodium iodide scintillators, lanthanum bromide scintillators, lithium scintillators or combinations thereof.

In addition, the device may include a processor 240 including look-up tables 242 coupled to and accessible by said processor identifying radioactive contamination target levels to compare a detected level of contamination with the stored information and therefore direct the device to optimize the entire radioactive removal procedure. Target levels may be understood as acceptable radioactive contamination concentrations, which vary for each volatile radioactive substance. Such optimization may include directing the device to operate under various microwave irradiation parameters including, e.g., irradiation time, contaminated material subjected to irradiation and remediation, depth of contamination, volatile radioactive isotopes, chemical compounds of the volatile radioactive isotopes, microwave radiation frequency or wavelength, pulse length for pulsed or modulated microwave emitters and irradiation power to provide selected temperatures at selected depths, for selected times and under selected conditions of vacuum, each variable being capable of independent regulation. For example, depending upon the detection operation, the device may operate at relatively low temperatures, low vacuum or short times for relatively low level contamination and at relatively high temperatures, high vacuum or longer times for relatively high levels of contamination.

As alluded to above, the collection device 200 includes a collection hood 220 which may be suspended over the earth surface material 212 to be treated. The collection hood 220 may act as a waveguide and/or shield, directing the microwave radiation towards the earth surface material to be treated and preventing microwave radiation from straying into the surrounding environment. The heating devices, i.e., the microwave source 216 and the optional infrared or laser source 222, are operatively coupled to the collection hood 220 in such a manner that the microwave radiation and optional infrared of laser radiation is directed towards the earth surface materials. For example, the microwave source, infrared source, laser source or combination thereof may be mounted directly onto the collection hood. Or, the microwave source, infrared source, laser source or combination thereof may be coupled indirectly to the hood 220 and the radiation directed to the area underneath the hood via a waveguide, such as waveguide 218. A suitable microwave source may include a magnetron or gyrotron and a suitable infrared or laser source may include quartz, quartz tungsten or carbon heating systems.

For applications that involve the physical collection and processing of the contaminated material, the collection hood may at least partially surround the contaminated material. In some embodiments, the hood may completely surround the contaminated material forming a microwave chamber. In such methods, the contaminated material may be collected and processed batch-wise in the microwave chamber.

Figure 3:
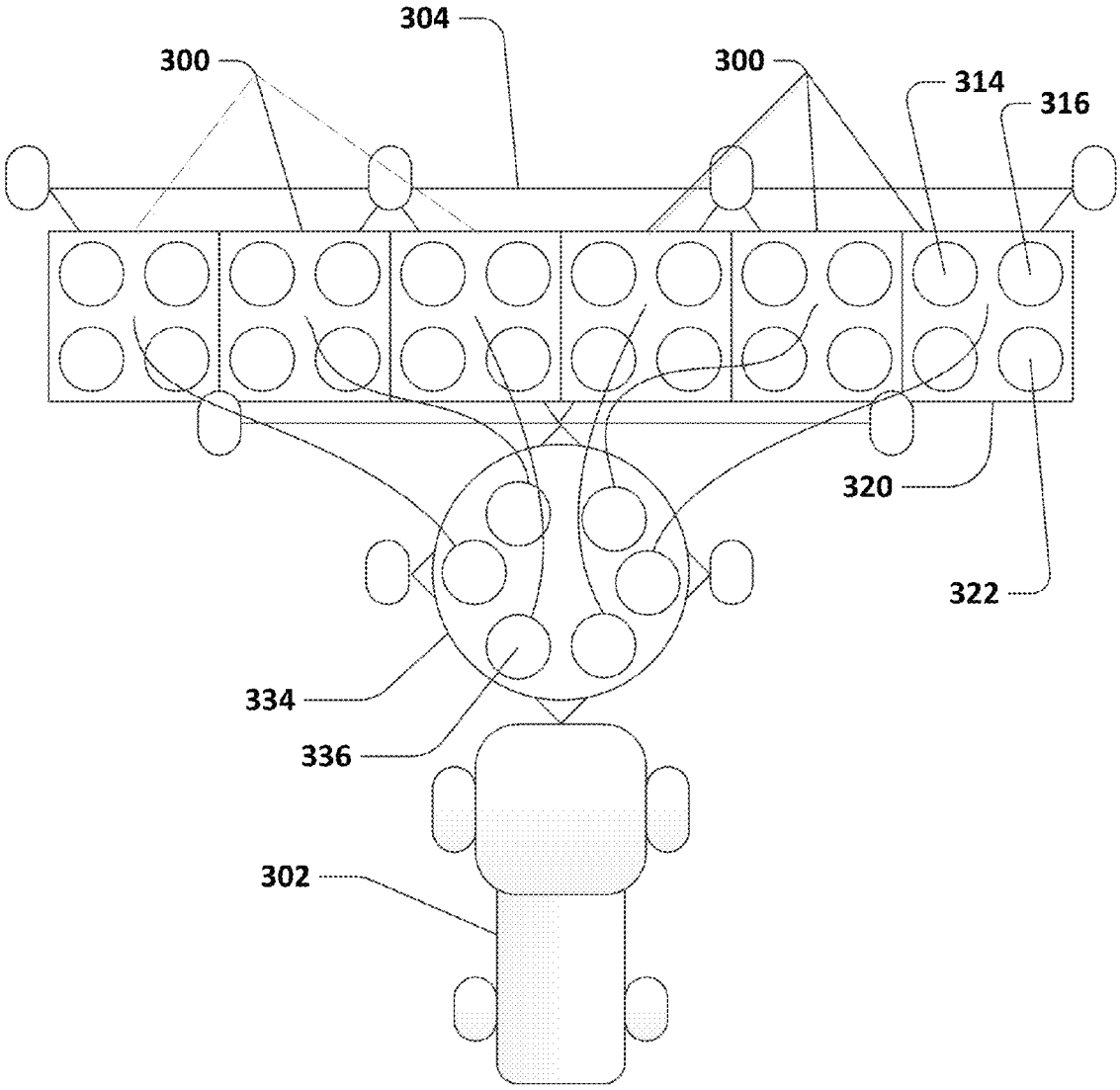
FIG. 3 illustrates schematic of a mobile apparatus for collecting a volatile radioactive substance.

The device may be integrated into a mobile system or vehicle, such as tractor trailers, farm tractors, street sweepers, sewer vacuums, or other commercial vehicles. FIG. 3 illustrates an example of mobile integration, wherein one or more collection devices 300 are coupled to a farm tractor 302 as an implement. As illustrated in FIG. 3, six collection devices 300 are utilized, however, from 1 to 20, collection devices may be used. The collection device(s) 300 may be provided on a mobile frame 304 that includes wheels or tracks, for example. The collection device(s) 300 may be dragged over a field or another relatively large surface area of ground at a desired rate. Again the collection device(s) may each include a collection hood 320, a microwave radiation source 316, an infrared radiation or laser source 322, and detection equipment 314. As illustrated, the recovery unit 334 and a reservoir 336 may be provided that is centralized, wherein multiple collection hoods 320 feed into a single recovery unit, as illustrated. Alternatively, individual recovery units may be provided for each collection hood.

Figure 4:
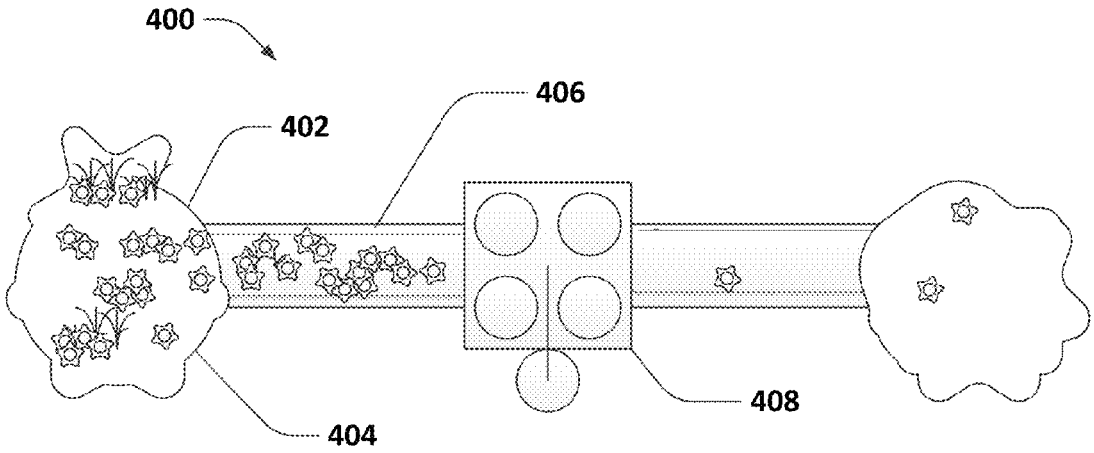
FIG. 4 illustrates a process for collecting a volatile radioactive substance from a contaminated material.

In other embodiments, the collection device may be implemented as part of a conveyor system 400, as illustrated in FIG. 4. The contaminated material 402 including the volatile radioactive substances 404 may be fed onto a conveyor belt 406. The conveyor belt 406 may be passed underneath a collection device 408 as described in FIG. 2 above. The contaminated material, including a reduced amount of volatile radioactive substance, may then be accumulated for redistribution. The rate of the conveyor belt may be controlled as one of the irradiation parameters that may be determined based on, for example, the volatile radioactive substance and the concentration thereof.

It may now be appreciated that the method and apparatus disclosed herein may provide relatively high throughput and high decontamination effectiveness potential while lowering the overall remediation cost in the case of radioactive contamination of earth surface materials. The method and apparatus has particular advantages over, e.g., zeolite application to soil (relatively low effectiveness and relatively long treatment times), chemical processing (low throughput and the need for chemicals) and soil scrapping (offsite disposal required). In such context, relatively higher amounts of soil reclamation may be achieved while reducing damage to existing vegetation or other biological systems present in the contaminated radioactive material environment depending on the depth of contamination and temperatures required for remediation.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method for collecting volatile radioactive substances from contaminated materials found on the surface of the earth, comprising:

providing a collection device including a collection hood, a microwave radiation source coupled to said collection hood, and a recovery unit in fluid communication with said hood;

suspending said collection hood over earth surface material;

irradiating a volatile radioactive substance on or under said earth surface material with microwave radiation from said microwave radiation source and vaporizing the volatile radioactive substance, wherein said volatile radioactive substance comprises at least one of cesium and iodine;

collecting said volatile radioactive substance in said collection hood; and recovering said vaporized volatile radioactive substance from said earth surface material by drawing said vaporized volatile radioactive substance into said recovery unit.

2. The method of claim 1, further comprising detecting and identifying the presence of said volatile radioactive substance with a detector.

3. The method of claim 2, further comprising selecting one or more radiation parameters based on a concentration of said volatile radioactive substance detected.

4. The method of claim 1, wherein said microwave radiation is adjusted to one or more frequencies within +/− 0.2 GHz of the resonant frequency of said volatile radioactive substance.

5. The method of claim 1, wherein more than one volatile radioactive substance is present, wherein each volatile radioactive substance exhibits a resonant frequency, and said microwave radiation is provided at more than one frequency within +/− 0.2 GHz of each resonant frequency of said volatile radioactive substances.

6. The method of claim 1, wherein said cesium or iodine is selected from one or more of the following isotopes: $^{131}I$, $^{135}I$, $^{137}Cs$, $^{134}Cs$, and $^{136}Cs$.

7. The method of claim 1, wherein said earth surface material is one or more material selected from the group consisting of soil, sand, clays, vegetation, environmental debris, roadways and building material.

8. The method of claim 1, wherein 50% to 100% by weight of said volatile radioactive substance is removed from said earth surface material.

9. The method of claim 1, wherein said collection device is coupled to a vehicle, wherein said method further comprises moving said vehicle over said earth surface material.

10. The method of claim 1 further comprising irradiating said volatile radioactive substance with an additional radiation source in conjunction with said microwave radiation source selected from the following: an infrared source, a laser radiation source and combinations thereof.

11. The method of claim 1, further comprising adding a chloride amendment to said earth surface material.

12. The method of claim 1, wherein said volatile radioactive substance is vaporized into a carrier gas and recovering further comprises drawing said carrier gas and said volatile reactive substance into said recovery unit and collecting said volatile radioactive substance in a reservoir.

13. The method of claim 1, wherein said earth surface material including said volatile radioactive substance is passed under said microwave radiation via a conveyor.

14. The method of claim 1, wherein said earth surface material is placed into a microwave chamber.

15. The method of claim 12, wherein said volatile radioactive substance and said carrier gas is drawn into said recovery unit with a vacuum pump.

* * * * *